US009061855B2

(12) United States Patent
Buerge

(10) Patent No.: US 9,061,855 B2
(45) Date of Patent: Jun. 23, 2015

(54) METHOD AND DEVICE FOR THE TRANSFER OF PRINTED PRODUCTS

(75) Inventor: Norbert Buerge, Wald (CH)

(73) Assignee: FERAG AG, Hinwil (CH)

( * ) Notice: Subject to any disclaimer, the term of this patent is extended or adjusted under 35 U.S.C. 154(b) by 0 days.

(21) Appl. No.: 13/468,529

(22) Filed: May 10, 2012

(65) Prior Publication Data

US 2012/0292156 A1 Nov. 22, 2012

(30) Foreign Application Priority Data

May 16, 2011 (CH) ..... 816/11
Jul. 13, 2011 (CH) ..... 1174/11

(51) Int. Cl.
*B65H 29/02* (2006.01)
*B65H 29/66* (2006.01)
*B65H 29/00* (2006.01)

(52) U.S. Cl.
CPC ..... *B65H 29/6609* (2013.01); *B65H 29/003* (2013.01); *B65H 2301/44712* (2013.01); *B65H 2301/44732* (2013.01); *B65H 2405/552* (2013.01); *B65H 2405/58* (2013.01)

(58) Field of Classification Search
CPC ..... B65H 29/6609; B65H 29/003; B65H 2301/44712
USPC ..... 198/460.3, 470.1
See application file for complete search history.

(56) References Cited

U.S. PATENT DOCUMENTS

| | | | | |
|---|---|---|---|---|
| 4,606,173 | A | 8/1986 | Meier | |
| 4,666,143 | A * | 5/1987 | Reist | 271/204 |
| 4,752,684 | A * | 6/1988 | Herrmann | 250/302 |
| 4,896,874 | A * | 1/1990 | Muller | 271/186 |
| 4,953,847 | A * | 9/1990 | Honegger | 271/277 |
| 4,983,990 | A * | 1/1991 | Frohlich | 347/101 |
| 5,810,347 | A * | 9/1998 | Wingate | 271/204 |
| 6,578,843 | B2 * | 6/2003 | Honegger | 271/204 |
| 6,817,608 | B2 * | 11/2004 | Sloan et al. | 271/216 |
| 6,976,674 | B2 * | 12/2005 | Honegger | 271/204 |
| 7,784,602 | B2 * | 8/2010 | Mueller | 198/470.1 |
| 7,845,485 | B2 * | 12/2010 | Honegger | 198/418.2 |
| 8,297,432 | B2 * | 10/2012 | Stauber | 198/470.1 |
| 2003/0015837 | A1 | 1/2003 | Reist | |
| 2003/0164588 | A1 * | 9/2003 | Gosslinghoff | 271/205 |
| 2003/0185663 | A1 * | 10/2003 | Mader et al. | 414/788.3 |
| 2010/0200363 | A1 * | 8/2010 | Muller | 198/418.2 |

FOREIGN PATENT DOCUMENTS

| | | |
|---|---|---|
| DE | 19523164 | 2/1996 |
| EP | 0128334 | 12/1984 |

(Continued)

*Primary Examiner* — Gene Crawford
*Assistant Examiner* — Thomas Randazzo
(74) *Attorney, Agent, or Firm* — Rankin, Hill & Clark LLP

(57) ABSTRACT

A device with a gripper conveyor and with a conveying-away device as well as with means for transferring two-dimensional products fed by the gripper conveyors, to the conveying-away device amid the formation of an imbricate formation, wherein the device forms a transfer region, in which the gripper conveyor is arranged above the conveying-away device. At least two, preferably at least three product release devices which are arranged in series after one another and distanced to one another, are individually activatable and are for the individual release of the products, are assigned to the gripper conveyor in the transfer region.

12 Claims, 4 Drawing Sheets

(56) References Cited

FOREIGN PATENT DOCUMENTS

| | | |
|---|---|---|
| EP | 1277685 | 1/2003 |
| EP | 1340704 | 9/2003 |
| EP | 1547951 | 6/2005 |
| WO | 2009064185 | 5/2009 |

* cited by examiner

METHOD AND DEVICE FOR THE TRANSFER OF PRINTED PRODUCTS

BACKGROUND OF THE INVENTION

1. Field of the Invention

The invention relates to a device with a gripper conveyor and a conveying-away device as well as means for transferring two-dimensional product units fed by the gripper conveyor, to the conveying-away device amid the formation of an imbricate formation, wherein the device forms a transfer region, in which the transfer of the product units from the gripper conveyor to the conveying-away device takes place.

2. Description of Related Art

With the manufacture of newspapers, magazines, periodicals, brochures or similar printed products, there often exists the necessity of feeding larger quantities of printed products to an intermediate storage. With regard to these printed products, it is often the case of intermediate products such as printed sheets, newspaper bundles or complete supplements, which are fed to further processing after the intermediate storage.

The necessity of the intermediate storage can have different reasons. Thus an intermediate storage can be necessary, for example, if the processing device arranged upstream processes and conveys further more printed products than can be received by a processing device arranged downstream, and the processing speed of the two devices cannot be matched to one another. The intermediate storage in this case serves as a buffer storage. Thus for example, rotation printing machines are operated at a defined speed for reasons of method technology as well as method economics. The ejection of the printed sheets from the rotation is set as a result of this and cannot be adapted to the processing capacity of the subsequent devices. Accordingly, the printed sheets must be led to an intermediate storage until the further processing, if the subsequent processing devices do not have sufficient processing capacities. For reasons of method economy, one can intentionally operate the processing device arranged upstream deliberately with a maximal speed, in order to provide as rapid as possible capacities for processing a new charge of printed products.

A further reason for the intermediate storage can be due to the fact that certain parts of a printed product to be manufactured, such as e.g. a newspaper, are produced in advance and intermediately stored as an intermediate product until the completion of the printed product. This is particularly the case when the printed product contains parts are current with regard to the day and which are only produced shortly before the completion of the printed product. The daily-current parts are then led together with the product parts fed from the intermediate storage, into the finished printed product.

A known type of intermediate storage is the winding-up of printed products continuously fed in an imbricate formation, together with a winding belt under tensile stress, into a product reel. The product reel can e.g. be wound on a winding core.

With regard to a functionally reliable handling and a space-saving storage, the product reel has significant advantages compared to other types of intermediate storage. The further processing of the printed products is effected by way of winding the products off from the product reel as an imbricate stream. Thus, for example, DE-A-42 21 911, DE-A-3532403 and DE-C-34 25 673 describe devices and methods for storing printed products in imbricate formation on a reel.

Before the winding up, the printed products at a transfer device must yet be brought into an imbricate formation depending on the manner in which the printed products are fed to the winding device. Thus the printed products, for example, can be fed to the winding device by way of a gripper conveyor in a manner held by individual grippers. The printed products are released from the grippers at a transfer device and are deposited in imbricate formation onto a conveyor belt. The imbricate stream is led away via the conveyor belt and fed to a winding station.

It is basically known to transfer printed products individually fed by a gripper conveyor to a belt conveyor in imbricate formation, at a transfer device. Thus, for example, DE-C-29 11 350 describes a device and a method for the transfer of individual printed products fed by way of grippers of a gripper conveyor, to a belt conveyor amid the formation of an imbricate formation. For this, the printed products with their free product edges in front are fed to the belt conveyor and are applied onto the previously released printed product in a manner shifted in the conveying direction. The still held printed product with this step assumes an orientation which is inclined with respect to the vertical, wherein the free product edge is aligned in a leading manner. The gripper is then opened and the product edge which was held until now is released, so that the printed product comes to lie on the belt conveyor. An imbricate formation is created by way of the offset or shifted depositing of the printed products. The opening of the grippers is effected in the known manner via a release member which e.g. can be a triggering apparatus operable by control or a mechanical control cam.

In order now to ensure a trouble-free winding-up procedure as well as a likewise trouble-free winding-off procedure and an unhindered further processing of the printed products which are wound off from the product reel and fed to a conveying-away device, a continuous, gapless imbricate stream of products must be fed to the winding device.

However, it is a fact that the gripper conveyor to be conveyed can often not feed a gapless product stream. Thus individual products always occur, which must be discharged from the product stream for reasons of quality, so that corresponding gaps arise. Moreover, gaps are also created if sample examples are removed from the product stream for examination.

BRIEF SUMMARY OF THE INVENTION

It is therefore the object of the present invention to suggest a device, by way of which a gapless imbricate stream can be produced despite gaps in a product stream of individually fed two-dimensional product units.

This object is achieved by way of the features of the independent device claims and of the independent method claim. Further developments of the invention as well as preferred embodiments are to be deduced from the dependent claims. Thereby, the features of the method claims with regard to context are combinable with the device claims and vice versa.

The device indeed is characterised in that at least two, preferably at least three product release devices which are arranged one after the other in series in the conveying direction and distanced to one another, are individually activatable and are for the individual release of the two-dimensional product units, in particular for the individual opening of the grippers, are assigned to the gripper conveyor, in the transfer region. According to a first preferred embodiment of the invention, the device comprises exactly two product release devices and according to a second particularly preferred embodiment, the device comprise exactly three product release devices which are arranged in the transfer region in the described manner. The product release device in the transfer device and which is first viewed in the conveying direction is hereinafter indicated as the first product release device. The significance of the number of applied product release devices is dealt with in more detail in the context of the method procedure.

The term "gripper" is to be understood in the broadest sense as conveying elements which are in the position of holding the two-dimensional product units in an edge region in a clamping manner. Clips are also counted amongst these. The conveying elements can be designed as one part or of several parts. The grippers, however, are preferably conveying elements with a first gripper limb and a second gripper limb which is movable relative to the first gripper limb via a pivot axis and or an elastic section. The two limbs preferably via a pivot axis are movable relative to one another between an open and a closed clamping position. The grippers are preferably connected to a conveying chain and are led via this along a conveying path. However, it is also conceivable for the grippers to be fastened on individual conveying vehicles which are not connected to one another and to be led along a conveying path.

The term "product release device" is to be understood as a device which is in the position of releasing the product units held in a clamping manner by the grippers, out of the clamping holding. This is preferably effected by way of opening the grippers by way of a product release device which in this case may be a release device or a triggering apparatus known from the state of the art. Such a triggering apparatus is, for example, described in the Swiss patent application No. 2010 0716/10 which at the point in time of application has not yet been published.

The distance between two adjacent product release devices is usefully selected such that a plurality of conveying cycles (conveying pulses) of the gripper conveyor are present between the adjacent product release devices. A conveying cycle is formed in each case by one gripper.

A conveying cycle can receive one product unit. This product unit is preferably an individual product held by the gripper. The product unit can, however, also comprise two or more than two, equal or different products. In this case, the gripper grips several products. All or individual products of the product units are preferably two-dimensional and flexible, thus pliant products. These, in particular, can be printed products such as sheets, newspapers, magazines periodicals, brochures, pamphlets. With regard to the printed products, it can moreover be the case of finished printed products, supplements or part products of newspapers, magazines, periodicals, brochures, pamphlets or books.

In each case, a plurality of grippers led on a transport chain is arranged on the path section between two product release devices, during operation of the device. 30 to 80 cycles or grippers can be lie between the first and the last product release device, seen in the conveying direction. This corresponds to a distance of 3 to 8 m.

The transfer region of the device defines that region, in which the gripper conveyor and the conveying-away device meet and in which the transfer of product units from the gripper conveyor to the conveying-away device takes place.

The device with the function for closing or producing gaps, according to the invention, is preferably designed such that the products are transferred in the transfer region to a common conveying-away device. The product release devices accordingly transfer the products preferably to a common conveying-away device. The device thus in the transfer region contains one, preferably exclusively one conveying-away device which is supplied by several product release devices.

The conveying directions or conveying paths of the gripper conveyor and of the conveying-away device are essentially equally directed in the transfer region. The conveying direction or the conveying paths of the gripper conveyor and of the conveying-away device preferably run parallel to one another in the transfer region. Moreover, the conveying path of the gripper conveyor and of the conveying-away device in the transfer region preferably runs over a straight section. The straight sections advantageously are horizontally aligned. It can however also be inclined.

The conveying-away device is preferably a belt conveyor with a conveyor belt, on which the product units released by the gripper conveyor are deposited in an imbricate formation. The conveying belt can be a hinge belt chain, a module belt chain or a conveying belt.

A vacuum device can also be assigned to the conveying away device and at one or more locations or regions along a gas-permeable conveyor belt and below this can produce a vacuum, so that the product units are additionally held on the conveyor belt and secured against slippage by way of the induced draft produced by way of this. This is effected by way of the air of the surroundings being sucked through the gas-permeable conveyor belt.

The gripper conveyor in the transfer region, with regard to the gravity, is preferably arranged above or over the conveying-away device, so that the product units guided in a hanging manner point to the conveying-away device with their free product edge. The gripper conveyor and the conveying-away device and in particular their conveying paths in the transfer region are preferably arranged relative to one another and distanced to one another, in a manner such that the product units held by the grippers, in the transfer region, lie or bear with their free product edges on the conveying-away device, in particular on the conveyor belt of a belt conveyor, and the free edges of the product units in the transfer region are in each case trailing with respect to the product edges held by the grippers.

For carrying out the method according to the invention, the device usefully contains a control unit, by way of which amongst other things the product release devices can be individually activated for the release of the product units, in particular for opening the grippers. Moreover, the device for carrying out the method according to the invention preferably also contains a sensor device, by way of which empty grippers and thus product gaps, in particular their size and position can be detected. The sensor device for this is usefully arranged on the gripper conveyor and, seen in the conveying direction, is arranged in front of the first product release device. The sensor device can, for example, comprise a sensor arm which is deflected by the products which are led past, wherein the deflection of the sensor arm activates a corresponding count impulse. The sensor device can also be an opto-electronic device as is described e.g. in WO 2008/119192.

The method according to the invention for producing a gapless imbricate stream by way of the device described above contains the known steps:

- feeding a gapless sequence of two-dimensional product units by way of gripper conveyors to the transfer region;
- releasing the product units at the first product release device, in particular by way of opening the grippers holding the product units;
- transferring the released product units to the conveying-away device amid the formation of an imbricate formation.

The method according to the invention is characterised by the following steps:

determining a product gap at the gripper conveyor, said product gap connecting to the gapless product sequence, wherein the determining is preferably effected in front of the transfer region seen in the conveying direction;

releasing the last product unit of the gapless product sequence at the first product release device;

lowering the conveying-away speed at the conveying-away device from a regular conveying-away speed to a lower, temporary conveying-away speed;

feeding two-dimensional product units of a subsequent product sequence which are subsequent to the product gap, into the transfer region and further conveying the product units past the first product release device to a further product release device which is arranged downstream in the conveying direction;

increasing the conveying-away speed in a manner such that the regular conveying-away speed is reached again when the first product unit of the subsequent product sequence which is fed by the gripper conveyor, catches up with the last product unit of the preceding product sequence which is released to the conveying-away device, releasing product units of the subsequent product sequence which connect directly to the product gap, at the further product release device arranged downstream and transferring the released product units to the conveying-away device amid the formation of an imbricate formation:

releasing the product units of the subsequent product sequence which pass the first product release device, by way of the first product release device, at the earliest on re-reaching the regular conveying-away speed, and transferring the released product units to the conveying-away device whilst forming an imbricate formation.

"Regular conveying-away speed" is to be understood as that conveying speed, with which the conveying-away device is operated under normal conveying conditions, i.e. when no product gaps need to be closed. The regular conveying-away speed is synchronised with the feed speed of the gripper conveyor. It can therefore be indicated as the "synchronous speed". The regular conveying-away speed can e.g. correspond to the feed speed or lie slightly below or above the feed speed. The regular conveying-away speed is preferably between 90 and 100%, preferably 95% of the feed speed of the gripper conveyor, i.e. of the gripper chain. In any case, the conveying-away speed is synchronised with the feed speed in a manner such that both conveyors can be operated under normal conveying conditions amid the formation of a uniform imbricate stream and preferably at a constant speed.

The temporary conveying-away speed is not synchronised with respect to the feed speed and can therefore be indicated as an "asynchronous speed" and the duration during which one travels with a temporary conveying-away speed is indicated as the "asynchronous phase". The speed profile of the temporary conveying-away speed is selected such that the product unit of the subsequent product sequence catches up with the last product unit of the preceding product sequence which is dispensed to the conveying-away device in a gapless manner in imbricate form, before or on reaching the further product release device arranged downstream. Preferably, no products are released to the conveying-away device during this asynchronous phase.

The speed profile which represents the course of the temporary conveying-away speed is preferably composed of a delay phase in which the conveying means is braked or delayed, as well as of an acceleration phase, in which the conveying means is accelerated. The speed profile in the delay phase and/or acceleration phase can correspond to a speed ramp. The delay phase can merge smoothly into the acceleration phase. The speed profile in this case is e.g. triangular.

The speed profile can also have an intermediate phase which lies between the delay phase and the acceleration phase and in which, preferably, a constant speed is present which however is lower compared to the regular conveying-away speed. The speed profile in this case is e.g. trapezoidal. The lowest speed or the speed of the intermediate phase can be 60 to 80%, in particular 70% of the regular conveying-away speed. The speed profile of the temporary conveying-away speed can be computed in a variable manner by way of the control unit, amongst other things by way of the selection of the ramp steepness or by way of fixing the speed course in the delay phase and acceleration phase and, as the case may be, in the intermediate phase, as well as by the absolute speed values.

One can also envisage the conveying-away device being stopped over a certain time interval during the closure of the gap. This can be the case, in particular, if larger product gaps must be closed. In this case, the conveying-away speed e.g. in an intermediate phase is equal to zero. In this context, it is explicitly mentioned that the speed profile of the "temporary conveying-away speed" can also contain sections in which the conveying speed of the conveying-away device is equal to zero. It is even conceivable for the speed profile of the "temporary conveying-away speed" to also be able to contain sections, in which the conveying speed of the conveying-away device is negative. This means the conveying-away device is operated running backwards. The speed profile however, in particular with comparatively small product gaps, is preferably designed such that the lowest conveying-away speed is larger than zero.

A product sequence can comprise one or more product cycles. To the same extent, a product gap can be one or more empty cycles or empty grippers in succession in a cycled product stream. An individual cycle can e.g. correspond to a conveying distance of approx 100 mm and a double cycle thus to a conveying distance of approx. 200 mm. If now a product gap runs with a single missing product unit into the transfer region, then the conveying away device for the gap closure must compensate or "destroy" a conveying distance of approx. 100 mm. This is effected by way of a conveying-away speed which is reduced during the asynchronous phase.

The determining of the product gap at the gripper conveyor, as already mentioned, can be effected via a sensor device which is arranged upstream of the transfer region. However, it is also possible for the product gaps to be determined already at that device, at which these are generated. This can be effected e.g. by way of the procedure of the receiving the products by the gripper or the procedure of product removal, e.g. at an ejection station, being monitored. Detection means which are known per se from the state of the art can be provided for this. The control unit receives the corresponding information from the mentioned devices. The detection of the position of the product gap or of the empty cycle at a certain point in time in the conveying device as well as its size, or the number of empty cycles, in the cycled product stream, is included when determining of the product gap. Moreover, the mentioned procedure preferably also includes the detection of the position of the product gap and its size in the cycle image of the control device. Only when the product gap and its size are reproduced in the cycle image of the control device can its position in the conveying device be determined at any point in time in the future by the control device.

Since the product stream at the gripper conveyor is cycled, the position of the individual grippers and thus of the individual product units or of the product gap can be computed at a certain point in time by the control unit. I.e., as soon as a product gap has been determined, the control unit is in the position of computing the position of the last product unit of a preceding product sequence as well as the position of the first product unit of a subsequent product sequence, at a certain point in time. Accordingly, the product release device can then be actuated at the correct point in time.

The product units of the subsequent product sequence which pass or reach the first product release device, are released again at the first product release device preferably from the point in time at which the first product unit of the subsequent product sequence which is fed by the gripper conveyor has caught up with the last product unit of the preceding product sequence which is dispensed to the conveying-away device. This can also of course yet take place after this point in time.

The expression "catch up with the product unit" in particular is to be understood in that the first product unit of the subsequent product sequence which is fed by the gripper conveyor has arrived at the level of the last product unit of the preceding product sequence which is dispensed to the conveying-away device or has a slightly set-back position to this last product unit for the seamlessly connecting imbricate formation.

Those product units which have already passed the first product release device at this point in time are yet released by the further product release device arranged downstream. This leads to the fact that the formation of an imbricate formation on the conveying-away device is initiated at the first product release device, whilst leading product units are still held by the grippers until reaching the product release device arranged downstream. A transient product sequence which is held by the gripper conveyor and which is arranged between two sequences of an imbricate formation at the conveying-away device arises by way of this. In order for the product units which are still guided at the grippers between these two product release devices, to be able to be integrated into the forming continuous imbricate formation in an unhindered manner, the product units held by the grippers, in the transfer region, lie with their free product edges on the conveying-away device, in particular on the conveyor belt of a belt conveyor. The free edges of these product units in the transfer region are moreover preferably trailing with respect to the oppositely lying product edges held by the grippers.

The conveying-away device usefully reaches the regular conveying-away speed at the latest at the point in time of the release or dispensing of the first product unit of the subsequent product sequence to the further product release device arranged downstream. However, it is also possible and indeed desirable for the conveying-away device to reach the regular conveying speed again before the point in time of the release or dispensing of the first product unit of the subsequent product sequence to the further product release device arranged downstream.

In a preferred embodiment of the method, at the latest from the point in time of the dispensing of the first product unit of the subsequent sequence to the further product release device which is arranged downstream, the subsequent product unit of the second product sequence which from this point in time passes the first product release device is released again at the first product release device and dispensed it to the conveying-away device, in particular by way of opening the respective grippers at the first product release device.

The product units passing the first product release device, in particular from the point in time of the re-reaching of the regular conveying-away speed subsequent to a temporary conveying away speed, are again released or dispensed at the first product release device, in particular by way of opening the associated grippers. Those product units which have already passed the first product release device at this point in time, are yet released or dispensed by the further product release device arranged downstream.

The device according to the invention as well as the associated method can generally be applied in fields of conveying technology where individually fed, two-dimensional product units are to be brought into a gapless imbricate stream. The field of application can also lie outside the processing of printed products. Particularly preferably, the device according to the invention and the associated method are applied in the context of a winding device, as is for example described in the discussion of the state of the art as well as described in the subsequent embodiment example. The device according to the invention thus in a preferred application can also contain a winding device for creating product reels. The conveying-away device hereby executes the function as a feeder for the winding device. The product units are hereby fed by the conveying-away device in the form of a gapless imbricate stream to the winding device.

The conveying-away device and the conveying devices and processing devices connecting thereto, such as a belt conveyor system and winding stations of the winding device are preferably connected to one another with regard to control technology. Thus for example the speed of the conveying-away device, of a subsequent belt conveyor system and the winding-up speed of the reel are preferably matched to one another and synchronised with one another. This means that a braking or acceleration of the conveying-away device also leads to a braking or acceleration of the belt conveyor and of a winding rotation at the winding station. A uniform product stream along the conveying path is ensured by way of this. Since the reel, on account of its comparatively high weight, reacts relatively sluggishly to changes of the winding speed, the accelerations should run in a gentle manner, e.g. in the form of relatively gentle speed ramps.

A great advantage of the present invention lies in the fact that the conveying speed of the gripper conveyor can be controlled independently of the product gaps which run into the transfer region. I.e. thanks to the method according to the invention, a gapless imbricate stream can be produced despite the product gaps, without the conveying speed of the gripper conveyor having to be adapted. Thus, the gripper conveyor can also be operated at a constant conveying speed even with the occurrence of product gaps. This aspect is important since the conveying speed of the gripper conveyor is set by the processing speed of processing devices arranged upstream, such as the rotation, and can therefore not be infinitely changed.

The device according to the invention yet provides a further advantage. Specifically, it is also suitable, in order on the conveying-away device, to form an imbricate stream with gaps or—expressed in other words—several imbricate streams which are distanced to one another by gaps and which are sequentially successive. The control device of the device according to the invention is accordingly designed for the implementation of the gap-formation method which is described further below. In this content, gap means that a distance is formed between a last product unit of a leading imbricate formation and a first product unit of a trailing imbricate formation, and no products overlap in this region.

If, for example, with regard to a winding device, the creation of a product reel at a first winding station is completed, e.g. because the product reel has reached its nominal size, then the imbricate stream must be diverted to a second winding station, in which e.g. one begins with the winding of a new product reel.

Since the imbricate stream continues to be continuously fed during the changeover of the product reel from the first to the second winding station, one must take care that a product jam or other complications do not occur during the changeover.

Thanks to the device according to the invention, now an imbricate stream with gaps can be produced on the conveying-away device. The point in time of the production of the gap is controlled by the control device in a manner such that this gap in the winding device passes the conveying section which is sensitive with regard to the changeover, between two winding stations at the point in time of the changeover. The sensitive conveying section can e.g. be a conveying diverter which is changed over when the product gap passes and thus diverts the product stream to another winding station. In other words: the point in time of the gap formation is matched to a planned change-over time at the winding stations, by way of the control device.

The method for the production of gaps in an imbricate stream by way of the device according to the invention contains the following steps:

- feeding a product sequence of two-dimensional product units by way of gripper conveyors to the transfer region;
- releasing product units at a first product-release device;
- transferring the released product units to the conveying-away device amid the formation of a first, gapless imbricate formation.

The method according to the invention is then characterised by the following steps:

- releasing a last product unit of the product sequence at the first product release device and transferring the last product unit to the conveying-away device as the last product unit of the first, gapless imbricate formation;
- increasing the conveying-away speed at the conveying-away device;
- feeding the subsequent product units of the product sequence into the transfer region and further conveying the product units past the first product release device to a further product release device which is arranged downstream in the conveying direction;
- lowering the conveying-away speed at the conveying-away device;
- releasing product units of the product sequence at the product release device arranged downstream and transferring the released product units to the conveying-away device amid the formation of a second imbricate formation distanced to the first imbricate formation;
- releasing product units of the product sequence which reach the first product release device, by way of the first product release device, at the earliest on re-reaching a lower conveying-away speed, and transferring the released product units to the conveying-away device amid continued formation of the second gapless imbricate formation.

The speed profile of the higher, temporal conveying-away speed is thereby selected such that a gap is formed between the first and the second imbricate formation. Since the gripper conveyor feeds product units to the transfer region with a uniform feed speed over the whole time, the mentioned gap opens due to the accelerated conveying-away of the leading imbricate stream. The product sequence fed to the transfer region by the gripper conveyor is gapless for example.

No product units are transferred to the conveying-away device during the increased conveying-away speed. Rather, held by the grippers, these run past the first product release device to a further product release device which is arranged downstream of this. In this time window, the conveying-away device can be operated at a greater conveying-away speed. The product units are not released until at the further product release device arranged downstream and form a subsequent, further imbricate stream at a distance to the leading imbricate stream. The conveying-away device at this point in time again has a lower conveying-away speed. From this point in time, the dispensing of the product units from the product release device arranged downstream is changed over again to the first product release device. For this, the product units are simply released again at the first product release device, wherein the product units which have already passed the first product release device are yet dispensed to the product release device arranged downstream.

The increase of the conveying-away speed at the conveying-away device is of a temporary nature and is preferably effected from a regular conveying-away speed. The conveying-away speed is then preferably lowered from the temporary high conveying-away speed back to the initial, lower regular conveying-away speed.

BRIEF DESCRIPTION OF THE DRAWINGS

The subject matter of the invention is explained in more detail hereinafter by way of embodiment examples which are represented in the accompanying drawings. In each case are shown schematically in.

The reference numerals used in the drawings and their significance are listed in a grouped manner in the list of reference numerals. Basically the same parts are provided with the same reference numerals in the figures.

DETAILED DESCRIPTION OF THE INVENTION

Figure 1:
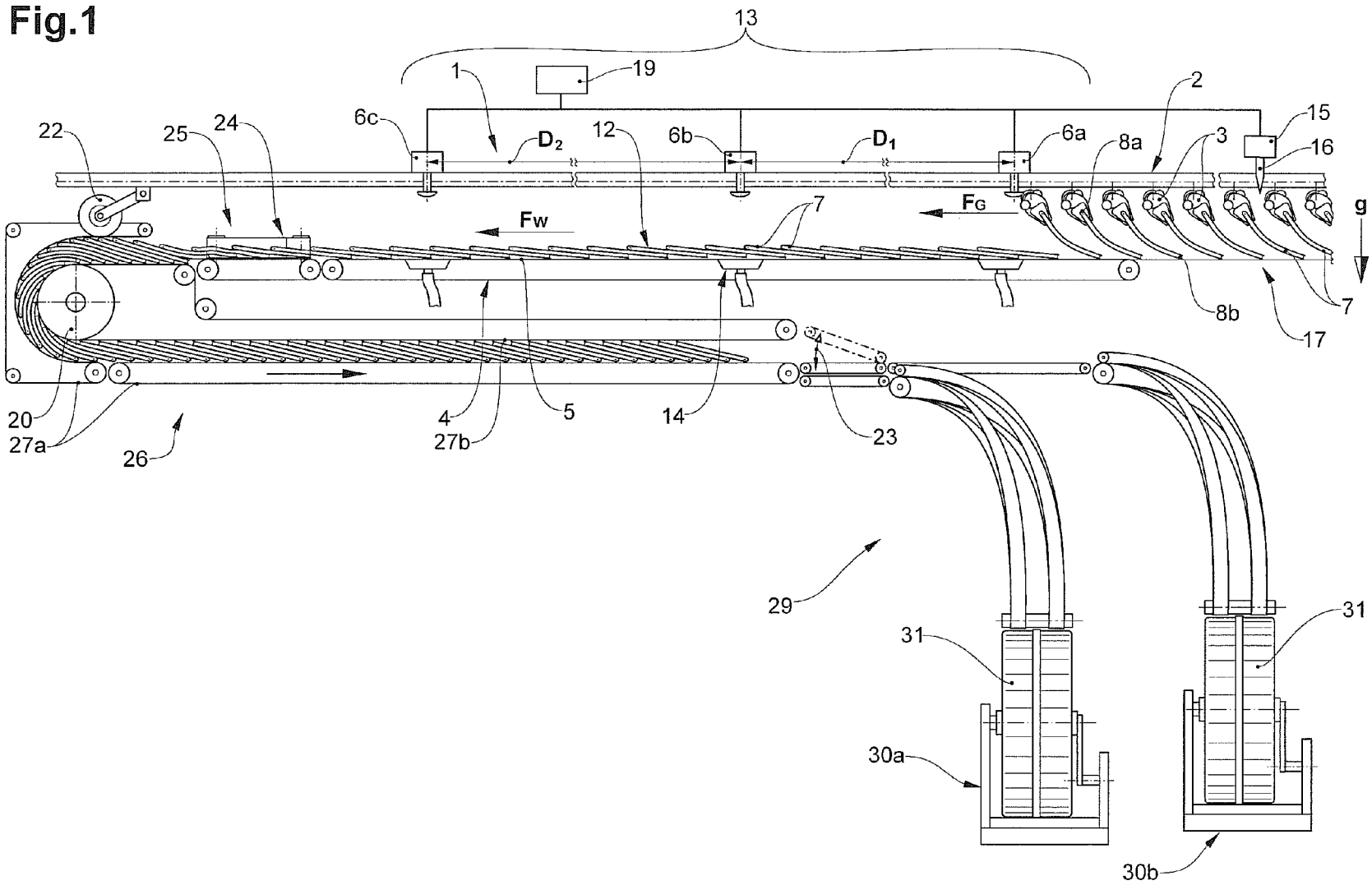
FIG. 1 a lateral view of the transfer region of the device according to the invention.
Figure 2:
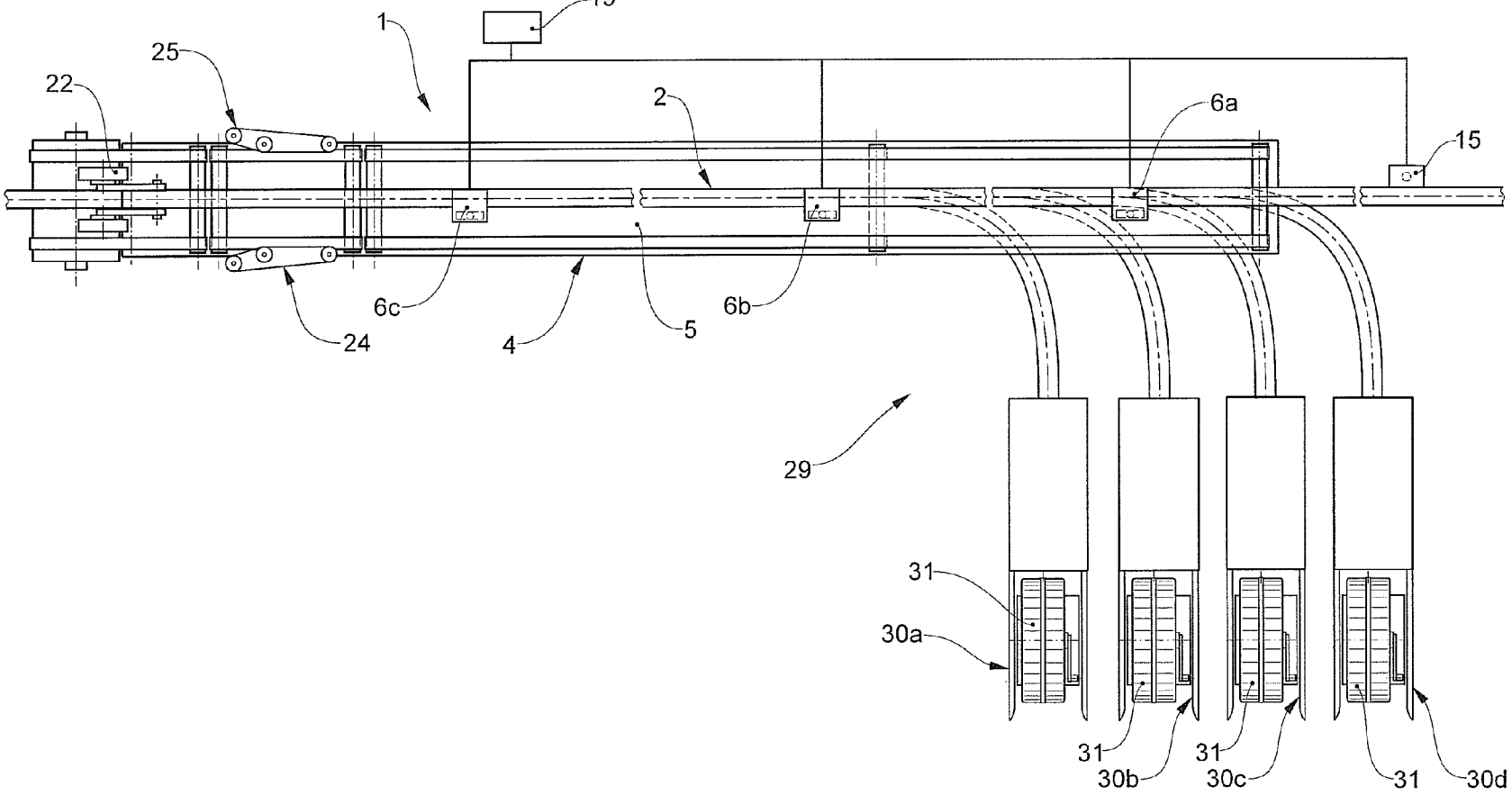
FIG. 2 a plan view of the transfer region of a device according to the invention.

The device 1 according to FIGS. 1 and 2 comprises a winding device 29 with several winding stations 30, 30*b*, 30*c* as well as with a gripper conveyor 2 feeding two-dimensional product units 7 and with a conveying-away device 4 conveying away the product units 7 to one of the winding stations 30*a*, 30*b*, 30*c*. The imbricate stream 12 can be fed in each case to a certain winding station 30*a*, 30*b*, 30*c*, 30*d* via a conveying diverter 23. The product units 7 here by way of example are individual two-dimensional products.

The gripper conveyor 2 and the conveying-away device 4 form a transfer region 13, in which the conveying path of the gripper conveyor 2 and of the conveying-away device 4 run parallel to one another over a straight conveying section.

The conveying section in the transfer region 13, in the present embodiment is designed in a horizontal manner. It can however also be inclined. The associated conveying member is a conveyor belt 5. The grippers 3 of the gripper conveyor 2 with regard to gravity lie above the conveyor belt and guide the two-dimensional products 7 in a hanging position into the transfer region 13. The products 7 for this are held at a first product edge 8*a* by the grippers 3. A second free product edge 8*b* which lies opposite the first product edge 8*a* is directed to the conveyor belt 5.

The distance between the grippers 3 and the conveyor belt 5 in the transfer region 13 is set such that the products 7 held in a hanging manner by the grippers, lie with their free product edges 8*b* on the conveyor belt. The free product edge 8*b* is thereby trailing with respect to the held product edge 8*a*. I.e. the free end sections of the products 7 are dragged along in the conveying direction $F_G$ with respect to the held regions. The product 7 can be deposited in an ordered manner in an imbricate formation on the conveyor belt 5 since the free product edge 8*b* is already aligned and guided on the conveyor belt 5.

According to the embodiment according to FIGS. 1 and 2, three product release devices in the form of triggering apparatus 6*a*, 6*b*, 6*c* are arranged in series one after the other and in each case distanced to one another, in the transfer region 13. Of course, two or even four or more than three triggering apparatus can be provided. The triggering apparatus 6*a*, 6*b*, 6*c* are connected to a control unit 19 which permits the individual actuation of the release devices 6*a*, 6*b*, 6*c*.

The grippers can be individually opened on passing the triggering apparatus 6*a*, 6*b* 6*c*. Such triggering apparatus 6*a*, 6*b*, 6*c* and the release mechanism on which these are based on, are known per se by the man skilled in the art, from the state of the art. The triggering apparatus are characterised in each case in that the releases mechanism, on which the triggering apparatus is based, can be electrically activated, wherein suitable control commands are generated via the control unit 19 for this purpose and are transferred to the triggering apparatus.

A sensor device 15 is attached on the gripper conveyor 2 in front of the transfer region 13, and serves for detecting product gaps 11. The sensor device 15 comprises a count finger 16, by way of which empty grippers 3 and, thus, gaps in the product stream 17 can be determined. The product gaps 11 can however also be detected in a different manner.

The product held in the gripper 3 is released on opening this by way of the triggering apparatus 6*a*, 6*b*, 6*c*. On account of gravity, the product with its held region falls downwards, by which means this is deposited onto the conveyor belt 5 lying therebelow. Since the products 7 already lie on the conveyor belt 5 with their free product edges 8*b* before them being dispensed, the deposition of the products 7 takes place in a controlled and secure manner. The grippers 3 can additionally be led in an inclined manner opposite to the conveying direction $F_G$, for supporting the transfer process as well as for an improved alignment of the products 7.

The conveyor belt 5 of the belt conveyor 4 is designed in a revolving manner and comprises a conveying section. In the region of this conveying section, a vacuum device 14 is provided on the lower side of the conveyor belt 5, by way of which vacuum device surrounding air is sucked through the air-permeable conveyor belt 5. In this manner, a suction force is also exerted onto the products deposited on the conveyor belt 5, so that these are optimally secured against slippage.

The imbricate stream 12 produced in the transfer region 13 is transferred at a transfer and alignment device 25 to belt conveying system 26, is deflected at a deflection roller 20 and is fed to a winding station 30*a*, 30*b*, 30*c*, 30*d* of the winding device 29. The fed imbricate stream 12 is laterally aligned at the transfer and alignment device 15 via a side guiding device 14 and during the transfer to the belt conveying system 26 is pushed together at push-on point at the end of the conveyor belt 5 of the belt conveyor 4, amid the compacting of the imbricate stream 12. This is effected by way of different belt speeds of the two conveying devices 4, 26. A pressing roller 22 ensures a stabilisation of the imbricate formation subsequent to the transfer. A reel belt (not shown) which is wound together with the imbricate stream into a product reel, can be fed to the imbricate stream subsequently to the transfer. The reel belt on the one hand serves for the stabilisation of the product reel and on the other hand as a separating element between imbricate layers as well as a winding-off aid with the later winding-off of the product reel. The imbricate stream 12 is supported by the belt conveying system 26 on both sides with a conveyor belt.

In FIG. 1, only two winding stations 30*a*, 30*b* are drawn for the purpose of an improved overview. Basically, the number of provided winding stations is not essential to the invention. However, also only one winding station can be provided. Moreover, the grippers 3 of the gripper conveyor 2 are only represented up to the first apparatus 6*a* in FIG. 1 likewise for the purpose of a better overview, although these are present over the complete shown conveying path.

Figure 3:
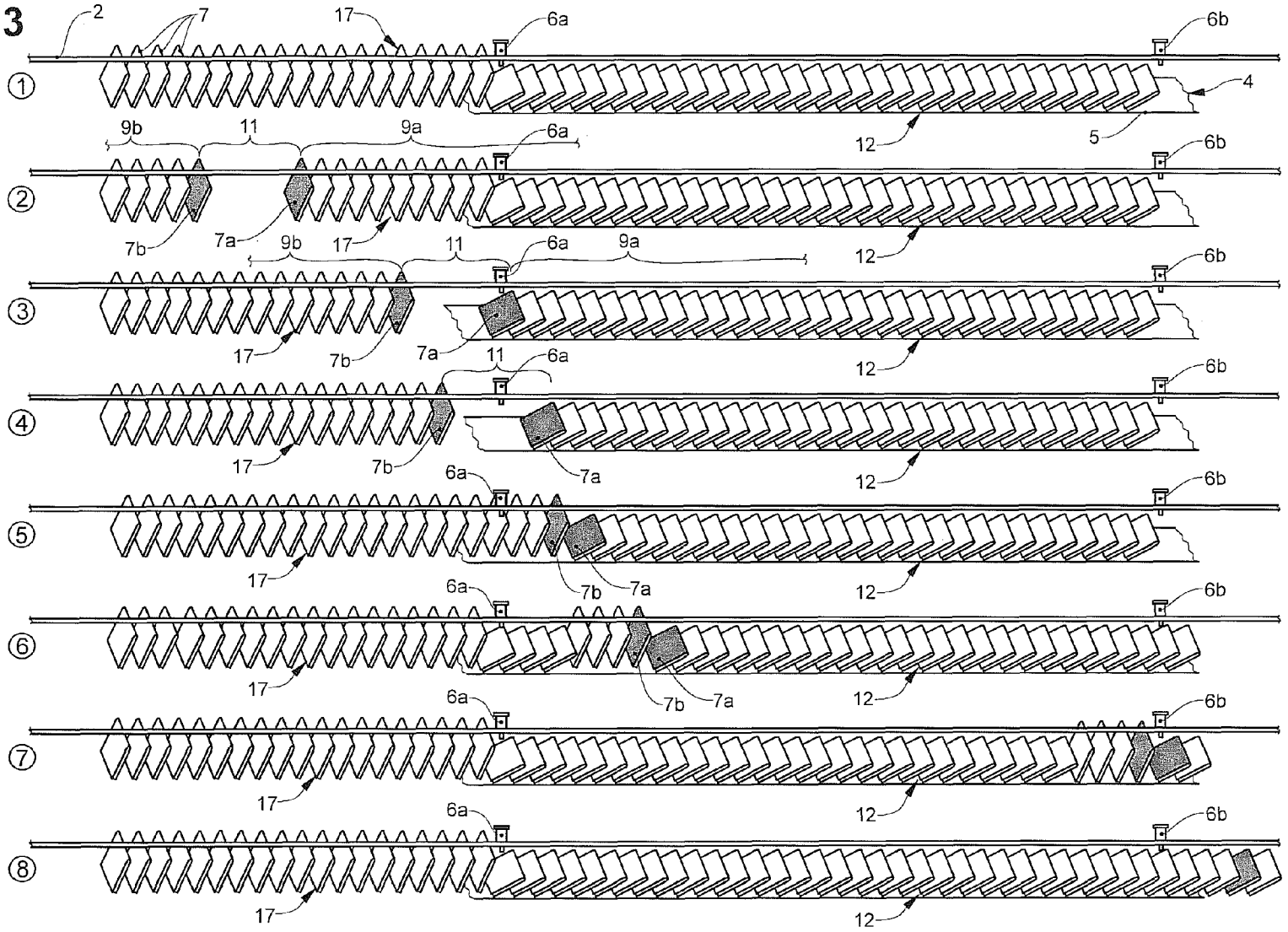
FIG. 3 the procedure of the closure of the gap, in the transfer region with two triggering apparatus.
Figure 4:
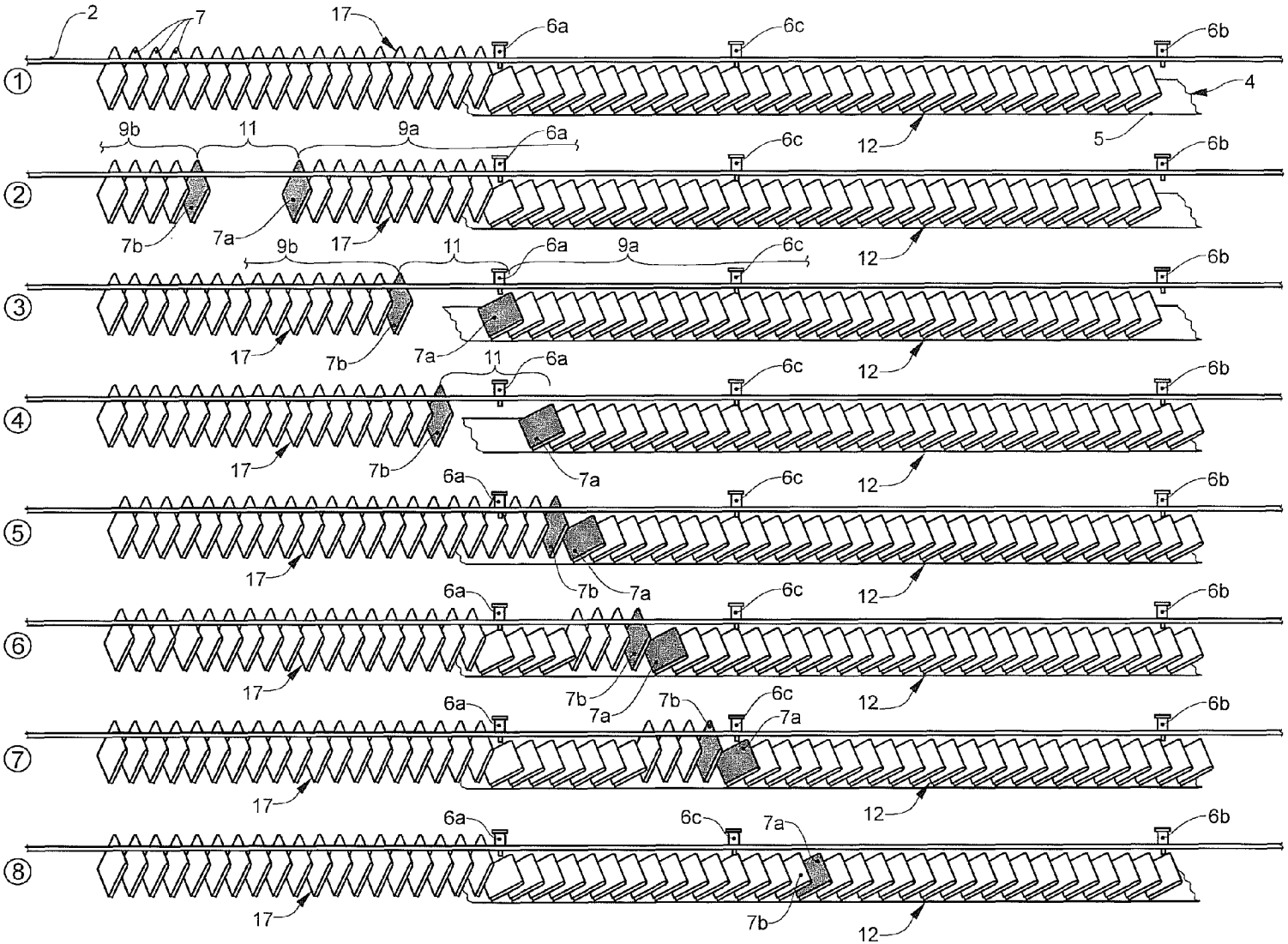
FIG. 4 the procedure of the closure of the gap in the transfer region with three triggering apparatus.

The method according to the invention is now explained in more detail by way of two embodiment examples in the FIGS. 3 and 4. Both FIGS. 3 and 4 show the creation of a gapless imbricate stream 12 in the conveying-away device 4 with the occurrence of a product gap 11 in the fed product stream 17 of a gripper conveyor 2 feeding products 7, in each case by way of eight picture sequences.

In the embodiment example according to FIG. 3, the device contains exactly two triggering apparatus 6*a* and 6*b*. In regular operation, i.e. if no product gaps 11 are led through the transfer region, the products 7 fed with the gripper conveyor 2 are released at the first triggering apparatus 6*a* and are deposited on the conveyor belt 5 of the belt conveyor 4 in imbricate formation (picture sequence 1). Instead of a belt conveyor 4 with a conveyor belt 5, one can also provide another conveying-away device or another conveying member, by way of which an imbricate stream can be produced.

In the further course, a product gap 11 with a plurality of empty cycles is fed to the transfer region 13. The product stream 17 is divided by the product gap into a preceding or leading product sequence 9*a* and into a subsequent or trailing product sequence 9*b* (picture sequence 2). All products 7 of the preceding product sequence 9*a* are released by the first triggering apparatus 6*a*. As soon as the last product 7*a* of this product sequence 6*a* has been released or deposited, the speed of the conveying belt 5 is reduced from a regular speed to a lower temporary speed. The gripper conveyor 2 however retains its conveying speed. The subsequent product sequence 9*b* catches up with the preceding product sequence 9*a* which is deposited on the conveyor belt 5, due to the different conveying speeds of the two conveyors 2, 4. This procedure takes place on the path section which lies between the first 6*a* and the second triggering apparatus 6*b*, during the so-called asynchronous phase. The speed of the conveyor belt 5 is thereby controlled in a manner such that the first product 7*b* of the subsequent product sequence 9*b* has caught up with the last product 7*a* of the preceding product sequence 9*a* before or at the latest on passing the second triggering apparatus. The speed of the conveyor belt is now controlled such that this again assumes the regular speed as soon as the first product 7*b* has caught up with the last product 7*a*. At the earliest from the point in time of the re-reaching of the regular conveying-away speed or also later, the products 7 of the subsequent product sequence are released again at the first triggering apparatus 6*a* (picture sequence 5 and 6).

Hereby, a transient sequence 18 of products 7 held in the grippers is produced and this sequence is delimited by a leading and trailing imbricate stream sequence and runs with the conveying speed of the gripper conveyor 2 through the path section between the first and the second triggering apparatus 6*a*, 6*b* (picture sequence 6 and 7). It is to be understood per se that the conveying-away speed, at least during the existence of this transient sequence 18, corresponds to the regular conveying-away speed.

The products 7 of this transient sequence 18 are yet released at the second triggering apparatus 6*b* on passing this, so that the two imbricate stream sequences close together into a gapless, uniform imbricate stream 12 (picture sequence 8).

The two triggering apparatus 6*a*, 6*b* according to FIG. 1 lie comparatively far apart, so that a comparatively long "catch-up stretch" is formed. Thus relatively large product gaps can also be closed with this arrangement. Additionally, in particular with large product gaps, the conveyor belt 5 can also be stopped for a certain time interval during the closure of the gap.

One could also be of the opinion that the two triggering apparatus 6*a*, 6*b* should lie as far apart as possible, so that larger product gaps can also be closed without any problem. However, one must consider the fact that further gaps which are subsequent to the first product 7*b* of the subsequent product sequence and which still lie within the number of product cycles which correspond to the total length of the path section defined between the two triggering apparatus 65*a* and 6*b*, cannot be closed.

The two triggering apparatus should therefore not lie too far apart, in order to also be able to close several smaller product gaps which follow one another in a close manner. A solution to these contradictory demands on the positioning of the two triggering apparatus relative to one another then lies in the provision of three or more than three triggering apparatus.

FIG. 4 by way of example shows an arrangement of three triggering apparatus 6*a*, 6*b*, 6*c*. In the picture sequences 1 to 8, the procedure of the gap closure is shown by way of the same product gap 11 as is illustrated in FIG. 3. The procedure of the gap closure with the exception of the subsequently described differences is the same as in FIG. 3, which is why a renewed description of the identical method steps is omitted and rather one refers to the embodiments with regard to FIG. 3.

FIG. 4 differs from the embodiment according to FIG. 3 by way of the fact that a third triggering apparatus 6*c* is yet arranged between the first 6*a* and the second triggering apparatus 6*b*. Depending on the size of the product gap 11, now either the shorter distance between the first and the third triggering apparatus 6*a*, 6*c* or the longer distance between the first and the second triggering apparatus 6*a*, 6*b* can be selected for the connection of the first product 7*b* of a subsequent product sequence 9*b* to the last product 6*a* of a preceding product sequence 9*a*. With smaller product gaps 11, with which the shorter distance or "catch-up stretch" between the first and third a release device 6*a*, 6*c* is sufficient of the connection, the first product 7*b* and, as the case may be, further products of the trailing product sequence 9*b* which connect to this first product are released at the third triggering apparatus 6*c*. The number of product cycles which lie within the path section between the two triggering apparatus 6*a* and 6*c* and which correspond to the number of product cycles of the subsequent product sequence, within which further product gaps cannot be closed, is considerably smaller here. In other words: the procedure of the gap closure here is completed much more quickly, so that the method according to the invention can be carried out again afresh relatively quickly for further subsequent gaps.

With larger product gaps, with which the shorter distance between the first and the third triggering apparatus 6*a*, 6*b* is not sufficient for the connection, in contrast the first product and, as the case may be, further products of the subsequent product sequence which connect to this first product are not released until at the second triggering apparatus 6*b* (not shown in FIG. 4). Since apart from the position of the product gap 11, its size is also known to the control device, the control device 19 on account of the size of the product gap 11 can also ascertain, over which of the subsequent triggering apparatus 6*b*, 6*c* the product gap 11 should be closed. Moreover, the control unit 19 by way of the size of the product gap as well as the selected or available "catch-up stretch(es)", also determines the travelled speed profile in the asynchronous phase.

The operating manner of the first triggering apparatus 6*a* is analogous to the embodiment according to FIG. 3. Of course, one can also provide four or even more triggering apparatus. Three triggering apparatus however have been found to be an ideal arrangement, by way of which most product gaps can be closed on transfer, without however the complexity of the device becoming too large. Moreover, one should take into account the fact that the length of the required catch-up stretch can also additionally be co-determined via the control of the speed of the conveyor belt in the asynchronous phase. Moreover, one has also found that the frequency and size of the product gaps as a rule have a certain pattern and is not completely random. Thus on the one hand there are the so-called individual gaps which arise on account of rejection of individual product units due to quality shortcomings or on account of manual removal of individual product units for the purpose of control. These can occur in a numerous manner and also shortly after one another at comparatively small distances. With such product gaps, the subsequent triggering apparatus 6*c* with the shorter distance to the first triggering apparatus 6*a* is selected.

On the other hand however, there are also larger product gaps with e.g. 5 to 15 missing product units. These occur e.g. if a change of the paper roll is carried out in the upstream rotation or the adhesive locations on the paper roll must be removed and thus a brief interruption of the product occurs. These gaps, although being larger, however occur less frequently and not necessarily after one another at short distances. With such product gaps, the subsequent triggering apparatus 6*b* with the greater distance to the first triggering apparatus 6*a* is selected for the closure of the gap.

The method represented in FIGS. 3 and 4 can e.g. be applied in the device according to FIGS. 1 and 2, or the device according to the FIGS. 1 and 2 can be used for implementing the method according to FIGS. 3 and 4.

Thanks to the device represented in FIGS. 3 and 4, and the method according to the invention, e.g. the rotation from which the printed products are fed to the winding device, can be decoupled from the further processing which obtains the printed products where required from the winding device.

The invention claimed is:

1. A device comprising:

a gripper conveyor, a conveying-away device with a conveyor belt, a transfer region, in which the transfer of product units from the gripper conveyor to the conveyor belt of the conveying-away device takes place, transfer means for transferring two-dimensional product units that are fed by the gripper conveyor to the conveyor belt of the conveying-away device such that an imbricate formation is formed, wherein the transfer means comprises at least two product release devices that are arranged one after the other in series in a conveying direction and that are spaced from one another and that are assigned to the gripper conveyor in the transfer region, and wherein the at least two product release devices are individually activatable and are for the individual release of the product units, and a control unit configured to control the transfer means to form an imbricated stream;

wherein a distance between the at least two product release devices is selected such that a plurality of conveying cycles of the gripper conveyor have space between the at least two product release devices; and, wherein the control unit is configured to control the product release devices so that the product release devices are individually activated for opening the grippers.

2. The device according to claim 1, wherein the conveying directions of the gripper conveyor and of the conveying-away device are essentially equally directed in the transfer region, wherein the conveying directions of the gripper conveyor and of the conveying-away device run in parallel in the transfer region.

3. The device according to claim 1, wherein the gripper conveyor in the transfer region is arranged above the conveying-away device such that the product units are led in the grippers in a hanging manner.

4. The device according to claim 1, wherein the gripper conveyor and the conveying-away device in the transfer region are arranged relative to one another such that the product units held by the grippers, in the transfer region lie or bear with their free product edges on the conveyor belt, and the free product edges of the product units in the transfer region are in each case trailing with respect to the product edges held by the grippers.

5. The device according to claim 1, the device further comprises a winding device, and the conveying-away device is designed as a feeder for the winding device, by way of which the product units can be fed to the winding device as the imbricate stream.

6. The device according to claim 1, wherein a sensor device arranged upstream of the product release devices in the conveying direction is assigned to the gripper conveyor, said sensor device being operable to detect a position and number of empty grippers from which a position and size of product gaps can be determined.

7. A method for producing a gapless imbricate stream, comprising the following steps:

providing a gripper conveyor, providing a conveying-away device with a conveyor belt, providing a transfer region, in which the transfer of product units from the gripper conveyor to the conveyor belt of the conveying-away device takes place, forming an imbricated gapless sequence by providing transfer means for transferring two-dimensional product units that are fed by the gripper conveyor to the conveyor belt of the conveying-away device, wherein the transfer means comprises at least two product release devices that are arranged one after the other in series in a conveying direction and that are spaced from one another and that are assigned to the gripper conveyor in the transfer region, and wherein the at least two product release devices are individually activatable and are for the individual release of the product units, feeding the gapless sequence of two-dimensional product units by way of the gripper conveyor, to the transfer region;

releasing the product units at a first product release device;

transferring the released product units to the conveyor belt of the conveying-away device amid the formation of an imbricate formation, detecting a product gap at the gripper conveyor, said product gap connecting to the gapless product sequence, releasing a last product unit of the gapless product sequence at the first product release device;

lowering the conveying-away speed at the conveying-away device from a regular conveying-away speed to a lower, temporary conveying-away speed;

feeding product units of a subsequent product sequence, which are subsequent to the product gap, into the transfer region and further conveying the product units past the first product release device to a further product release device, which is arranged downstream in the conveying direction;

increasing the conveying-away speed such that the regular conveying-away speed is reached again when the first product unit of the subsequent product sequence, which is fed by the gripper conveyor, catches up with the last product unit of the preceding product sequence, which is released to the conveyor belt of the conveying-away device, releasing product units of the subsequent product sequence, which are directly subsequent to the product gap, at the further product release device arranged downstream and transferring the released product units to the conveyor belt of the conveying-away device amid formation of an imbricate formation;

releasing the product units of the subsequent product sequence, which reach the first product release device, by way of the first product release device, at the earliest on re-reaching the regular conveying-away speed, and transferring the released product units to the conveyor belt of the conveying-away device amid formation of an imbricate formation, wherein the speed profile of the temporary conveying-away speed is selected such that the first product unit of the subsequent product sequence has caught up in a gapless manner with the last product unit of the preceding product sequence, which is dispensed onto the conveyor belt of the conveying-away device, before or on reaching the further product release device arranged downstream, and wherein the product units held by grippers, in the transfer region, lie with their free product edges on the conveyor belt, and the free product edges of the product units in the transfer region are trailing with respect to the product edges held by the grippers.

8. The method according to claim 7, wherein from or after the point in time of the re-reaching of the regular conveying-away speed subsequently to a temporary conveying-away speed, the product units passing the first product release device are released again at the first product release device.

9. The method according to claim 7, wherein the product units passing the product release device are released again at the first product release device, before, from or after the point in time at which the first product unit of the subsequent product sequence, which is fed by the gripper conveyor, has caught up with the last product unit of the preceding product sequence, which is dispensed to the conveying-away device.

10. The method according to claim 7, wherein with more than two product release devices, the control unit in dependence on the size of the product gap, determines over which product release device products of the subsequent product sequence are released for the purpose of the closure of the gap, and/or the control unit fixes the profile of the temporary conveying-away speed during the asynchronous phase in dependence on the size of the product gap.

11. The method according to claim 7, wherein the conveying speed of the gripper conveyor is controlled independently of product gaps which run into the transfer region.

12. A method for the production of gaps in an imbricate stream, comprising the following steps:

providing a gripper conveyor;

providing a conveying-away device with a conveyor belt;

providing a transfer region, in which the transfer of product units from the gripper conveyor to the conveyor belt of the conveying-away device takes place;

forming an imbricated gapless sequence by providing transfer means for transferring two-dimensional product units which are fed by the gripper conveyor to the conveyor belt of the conveying-away device, wherein the transfer means comprises at least two product release devices that are arranged one after the other in series in a conveying direction and that are spaced from one another and that are assigned to the gripper conveyor in the transfer region, and wherein the at least two product release devices are individually activatable and are for the individual release of the product units;

feeding a product sequence of two-dimensional product units by way of the gripper conveyor to the transfer region;

releasing product units at a first product release device;

transferring the released product units to the conveyor belt of the conveying-away device amid the formation of a first, gapless imbricate formation;

releasing a last product unit of the product sequence at the first product release device and transferring the last product unit to the conveyor belt of the conveying-away device as the last product unit of the first, gapless imbricate formation;

increasing the conveying-away speed from a lower conveying-away speed to a higher conveying-away speed at the conveying-away device;

feeding the subsequent product units of the product sequence into the transfer region and further conveying the product units past the first product release device to a further product release device which is arranged downstream in the conveying direction;

lowering the conveying-away speed from the higher conveying-away speed to the lower conveying-away speed at the conveying-away device;

releasing product units of the product sequence at the further product release device arranged downstream and transferring the released product units to the conveyor belt of the conveying-away device amid the formation of a second imbricate formation distanced from the first imbricate formation; and releasing product units of the product sequence, which reach the first product release device, by way of the first product release device, preferably at the earliest on a re-reaching the lower conveying-away speed, and transferring the released product units to the conveyor belt of the conveying-away device amid continued formation of the second, gapless imbricate formation, wherein a speed profile of the higher conveying-away speed is thereby selected such that a gap is formed between the first and the second imbricate formation, and wherein the product units held by grippers, in the transfer region, lie with their free product edges on the conveyor belt, and the free product edges of the product units in the transfer region are trailing with respect to the product edges held by the grippers.

* * * * *